US008662143B1

(12) United States Patent
Foster

(10) Patent No.: US 8,662,143 B1
(45) Date of Patent: Mar. 4, 2014

(54) MOLD HAVING CERAMIC INSERT

(75) Inventor: Richard Allen Foster, Russiaville, IN (US)

(73) Assignee: Haynes International, Inc., Kokomo, IN (US)

( * ) Notice: Subject to any disclaimer, the term of this patent is extended or adjusted under 35 U.S.C. 154(b) by 0 days.

(21) Appl. No.: 13/599,236

(22) Filed: Aug. 30, 2012

(51) Int. Cl.
*B22C 9/00* (2006.01)
*B22D 29/00* (2006.01)

(52) U.S. Cl.
USPC ..... 164/132; 164/340

(58) Field of Classification Search
USPC ..... 164/131, 132, 137, 339, 340
See application file for complete search history.

(56) References Cited

U.S. PATENT DOCUMENTS 4,704,079 A 11/1987 Pluim, Jr.
7,302,989 B1 12/2007 Kamel et al.
2007/0187061 A1* 8/2007 Siddle et al. ..... 164/312

FOREIGN PATENT DOCUMENTS

JP 4-305340 A * 10/1992 ..... B22D 11/04

OTHER PUBLICATIONS

Translation of JP 4-305340 A.

* cited by examiner

*Primary Examiner* — Kevin P Kerns
(74) *Attorney, Agent, or Firm* — Buchanan Ingersoll & Rooney PC

(57) ABSTRACT

An ingot mold has a body having an open top, a bottom with an opening, and a longitudinal cavity passing through the body. The cavity is defined by a cavity wall extending from the top to the bottom. The cavity wall has a recess adjacent the opening in the bottom of the body. A ceramic insert is positioned within the cavity such that the sidewalls of the ceramic insert are in the recess in the cavity wall.

14 Claims, 3 Drawing Sheets

MOLD HAVING CERAMIC INSERT

FIELD OF INVENTION

The invention relates to molds used for metal casting such as cast iron molds into which hot metal is poured and allowed to cool to form an ingot or electrode.

BACKGROUND OF THE INVENTION

Many metal alloys are made by mixing raw metals in selected proportions in a furnace and heating the mixture at a desired temperature for a selected time to melt the metals. In many processes the molten metal is taken from the furnace in ladles. Other additives may be added to the molten metal while the melt is in the ladle. Then the metal is poured from the ladle into molds. These molds are often made of cast iron or another metal having a higher melting point than the metal being melted. Those temperatures are often in the range of 2750° F. to 2800° F. (1510° C. to 1538° C.). The molten metal solidifies in the mold to form an ingot, electrode or other metal product. The metal product is removed from the mold for further processing. The mold is cleaned and then reused to form other metal products.

Electrodes for arc welding and electric arc furnaces are commonly made by pouring molten metal into a cast iron tubular body that sits on a flat base. The molten metal solidifies inside that tubular body forming an electrode and then the tubular body is lifted off the base. Sometimes the electrode remains on the base when the tubular body is removed. At other times the electrode stays within the tubular body and must be removed from that body.

When the electrode is removed from a tubular body or base, pieces of metal will remain in the tubular body, stuck to the bottom or sides, or on the base. These pieces of metal must be removed before the tubular body and base can be reused. Depending upon the size of the electrode as much as 75 pounds (34 kg) of metal may be left behind and becomes scrap.

The pouring of hot metal into the electrode mold and the removal of the electrode causes wear on the mold. Consequently, electrode molds must be replaced or refurbished. Cast iron electrode molds have a life of about twenty heats. There has been a long, unsatisfied need for electrode molds, as well as other molds used to create other metal parts, which have a longer service life and which produce less scrap.

Molds having cavities much smaller than the cavity in an electrode mold or ingot mold are used for making molded plastic products and for casting metal parts. In the plastic molding industry there are two basic types of molds. One type of mold is created by removing material from mating mold plates such that when the two mold plates are put together the corresponding cavities in the mold plates define a single cavity that has the shape of the product to be molded. Because the mold plates are made from wear-resistant metal alloys, conventional machining of these plates is extremely difficult, expensive, time consuming, and is also limited to machining simple mold cavity geometries.

The second type of mold, known as an insert mold, has a mold body or mating mold plates which have a space that is sized to receive one or more inserts. Metal inserts are placed into the space machined into the mold plates or mold body. The inserts have cavities which together define the shape of the part to be molded. Inserts allow the use of lower cost and easier to machine metals for the mold plates and limit the use of wear-resistant metal alloys to the metal inserts. However, as with the first method, this approach requires expensive and time consuming metal removal methods to create the cavity shape within the metal insert.

It is also known in the art to use mold inserts made of a ceramic material in molds used for plastic injection molding. U.S. Pat. No. 4,704,079 to Mini Jr, discloses a multi-part mold for injection molding of plastic parts. This mold is made up of at least two parts. There is a mold block portion having a ceramic mold cavity insert. The ceramic mold cavity inserts define the walls of the mold cavity when the mold is closed. Each mold cavity insert comprises a shaped ceramic body having a mounting surface adapted to fit under compressive stress throughout the entire molding operation within a mounting cavity of the mold block portion.

Injection molding is extremely hard on molds. Although some ceramic inserts last longer than others, they all suffer eventually because of distortion, erosion of the mold cavity surface, heat checking from thermal shock, and for other reasons. In order for a ceramic insert to be utilized in a mold cavity for high pressure molding, it is necessary to secure it in a mounting cavity in the mold block or mold body portion in such a way as to maintain it in a state of compressive stress throughout the molding or casting cycle. This will provide a tight fit of the insert in the mold block despite differences in the thermal expansion and thereby provide efficient transfer of impact energy and thermal energy to the mold block. Consequently, the space that receives the ceramic insert, as well as the insert itself must be specially configured to fit together in a way that provides a tight fit.

U.S. Pat. No. 7,302,989 Kamel, et al. discloses a mold system that may include a method of producing a ceramic core usable in production of a turbine airfoil. The method may include building a mold plate having at least one mold cavity configured to receive an insert and installing an insert in that cavity. Installing the insert in the cavity preferably includes installing a ceramic insert fully or partially formed from silicon carbide. The insert may include a coating formed from a chemical vapor deposition of a nonporous material, which may be silicon carbide. The ceramic insert may be formed from a net shape process. The mold plate may be formed with soft steels, such as P20 or NAK55, aluminum, aluminum-epoxy, and other appropriate materials. Materials such as abrasive resistant steels are not preferred because such materials are difficult to machine and require EDM processes.

In the molding systems in which ceramic inserts have been used the amount of material that enters the mold cavity is usually a small fraction of the amount of molten metal that is poured in an electrode mold or ingot mold and those molds operate at much lower temperatures. Consequently, the use of ceramic inserts in molds for injection molding of plastics has not been considered as being transferrable to molds used in steel making.

SUMMARY OF THE INVENTION

I provide a mold useful for casting electrodes or other metal parts which has a body having an open top, a bottom with an opening, and a longitudinal cavity passing through the body. The cavity defined by a cavity wall extending from the top to the bottom of the body. There is a recess in the cavity wall adjacent the opening in the bottom of the body. A ceramic insert having sidewalls is positioned within the cavity such that the sidewalls are in the recess in the cavity wall. The body of the ingot mold preferably is cast iron. The ceramic insert preferably is made of a high alumina ceramic.

The ceramic insert fits within the recess in the cavity wall and is held in place with a bonding material. Molten metal is poured into the top of the mold to substantially fill the cavity. The molten metal cools within the cavity to form an electrode. Then the electrode and the ceramic insert are removed from the mold. During the removal the ceramic insert is attached to one end of the electrode. After removal of the electrode from the mold the ceramic insert is removed from the electrode.

Use of the ceramic insert eliminates all material loss from the end of the electrode covered by the insert, increasing the yield for the molding process. Additionally, a cast iron mold with a ceramic insert as disclosed here has a substantially longer service than a mold of the same size that is made entirely from cast iron.

Other objects and advantages of my mold with ceramic insert and method of casting electrodes using that mold will become apparent from a description of certain present preferred embodiments thereof which are shown in the drawings.

DESCRIPTION OF THE PREFERRED EMBODIMENTS

Figure 1:
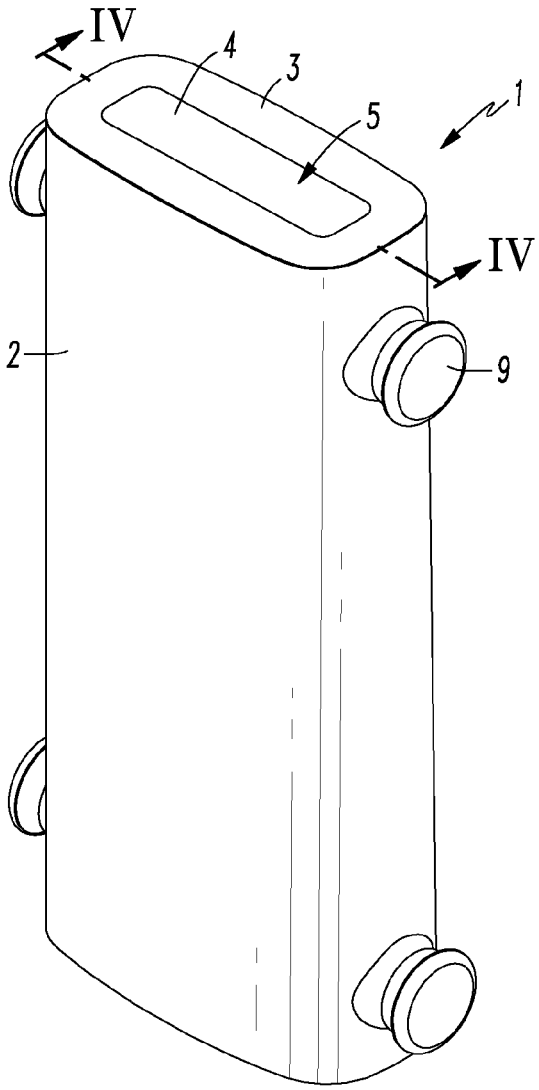
FIG. 1 is a perspective view of a present preferred embodiment of my mold having a ceramic.
Figure 2:
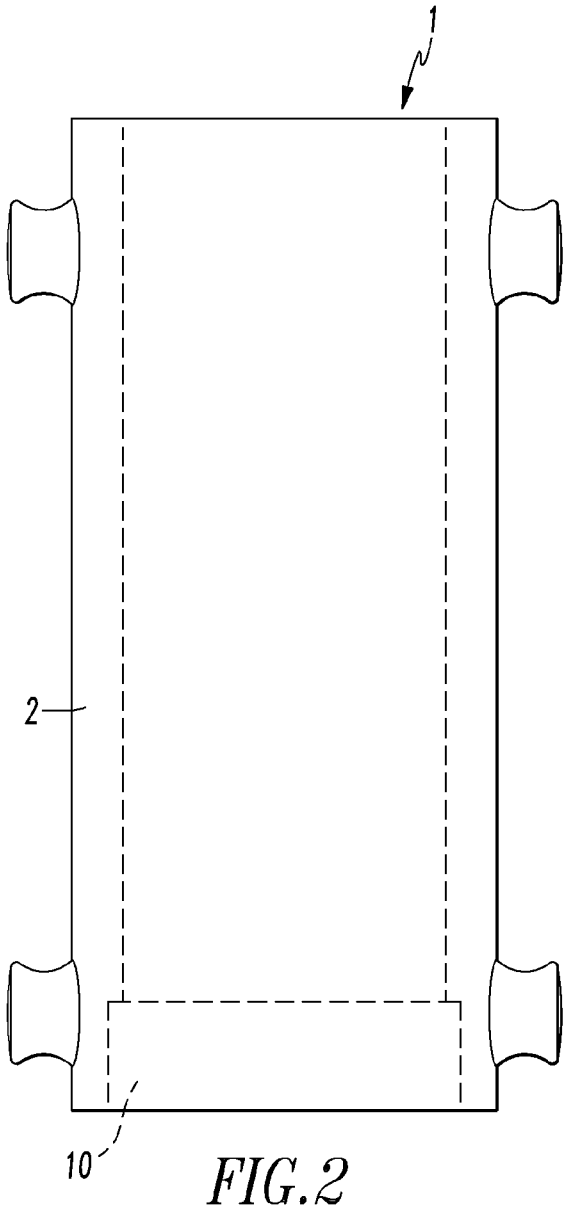
FIG. 2 is a front view thereof.
Figure 3:
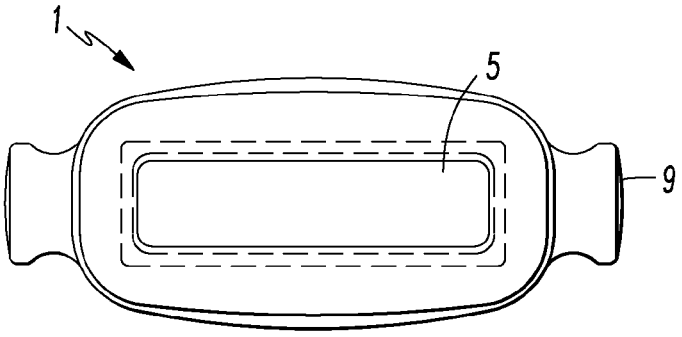
FIG. 3 is a top view thereof.

Referring to FIGS. 1 through 4 I provide an improved mold 1 for casting ingots, electrodes and other metal parts that has a tubular body 2 with an opening 4 in the top 3 of the mold. Handles or lugs 9 are provided on the mold which allowed the mold to be lifted by an overhead crane using hooks that grab the handles. As can be seen most clearly in FIG. 4, I provide a ceramic insert 10 that fits into the bottom of the mold closing off the mold cavity 5. A recess 8 is provided in the cavity wall 6 at the bottom of the mold 1. The recess is sized to receive the side walls 12 and end walls 13 of the ceramic insert 10 shown in FIGS. 5 through 8. A bonding material is applied to the ceramic insert before it is placed within the recess to hold the ceramic insert in the mold. A bonding material sold under the trade name LADLE LOCK by Reico Products, Inc. is suitable for this purpose. The binding material is applied to at least a portion of the sidewalls of the ceramic insert before the insert is placed in the mold. The ceramic insert 10, shown in FIGS. 5-8 and has a bottom 14, side walls 12, end walls 13 and an open top 15. The ceramic insert preferably is made from a high alumina ceramic material having 75-85% alumina and 10-15% silicon oxide. This ceramic material should have a service temperature of approximately 3000° F. Ceramic material sold by United Refractories Incorporated under the trade name UNICRETE 85 LC is a suitable ceramic material for the ceramic insert.

In one embodiment of my invention I provide an electrode mold that is approximately 9 feet tall and has a top opening of approximately 9 inches by 36 inches. The side walls and the end walls of the ceramic insert are preferably one foot high. The recess 8 should have the same depth as the height of the ceramic insert such that when the ceramic insert 10 is inserted into the mold 1 the ceramic insert will be flush with the bottom of the mold. Lugs 16 are provided on the insert for ease of handling. Although I prefer the side walls and end walls of the ceramic insert have a height of one foot, these walls can be as tall as two feet. Hence the recess 8 may cover from 11% to 22% of the cavity wall 6.

Figure 4:
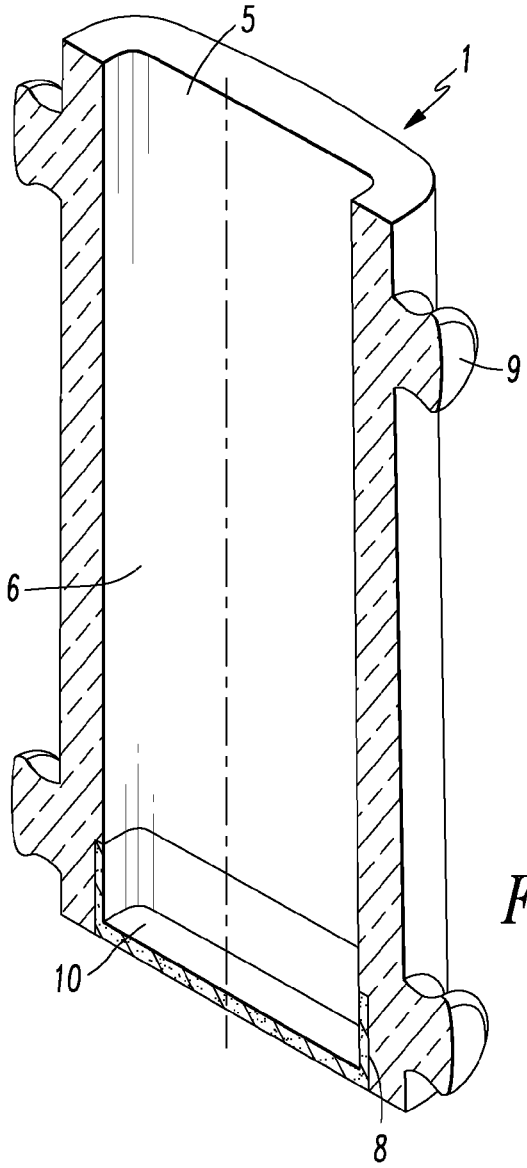
FIG. 4 is a sectional view taken along the line IV-IV in FIG. 1.
Figure 5:
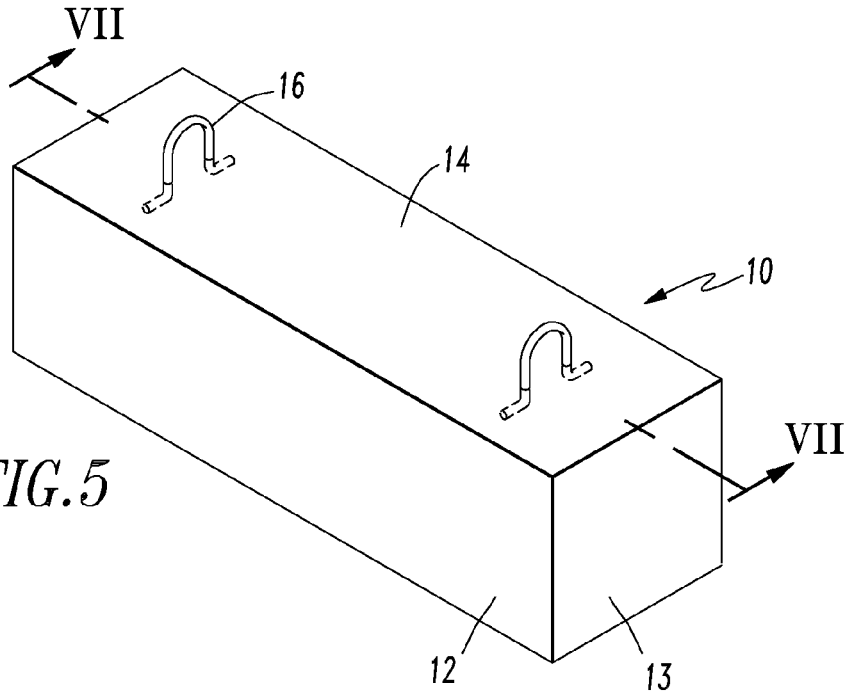
FIG. 5 is a perspective view of a present preferred embodiment of the ceramic insert used in the casting mold shown in FIGS. 1 through 4.
Figure 6:
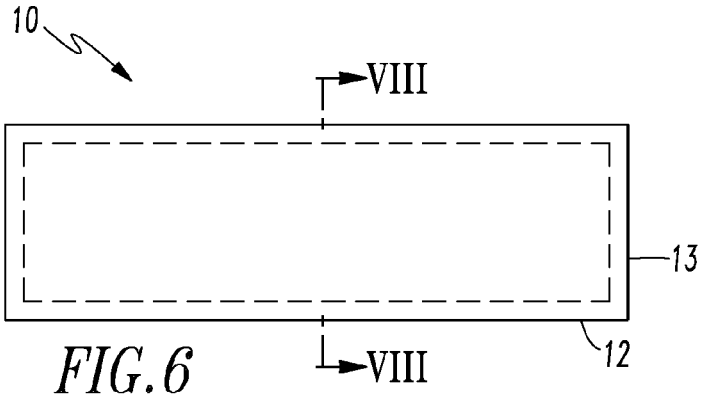
FIG. 6 is a bottom view of the ceramic insert shown in FIG. 5.
Figure 7:
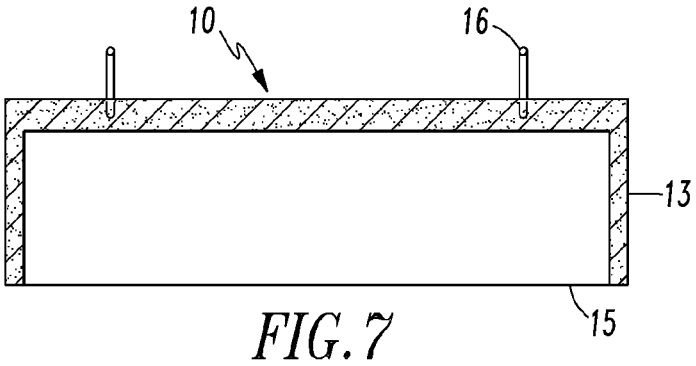
FIG. 7 is a sectional view taken along the line VII-VII in FIG. 5.
Figure 8:
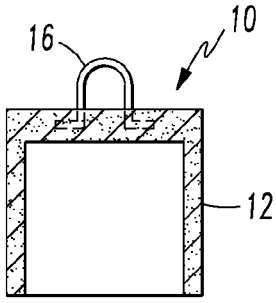
FIG. 8 is a section view taken along the line VIII-VIII in FIG. 6.

The ceramic insert is placed in the mold as shown in FIG. 4. Hot metal is then poured into the opening 4 at the top of the mold to fill cavity 5. As the hot metal is poured into the bottom of the mold the metal will begin to pool first within the ceramic insert and then up through the cavity. As the metal begins to pool there is substantial turbulence within the molten metal. This turbulence decreases as the mold is filled. Such turbulence has caused wear in cast iron molds without the ceramic insert, with the most wear occurring at the bottom of the mold. The turbulence is significantly lower when the depth of the molten metal in the ingot mold is about one foot. That is why I selected the height of the walls of the ceramic insert to be one foot high. For some molds, one may find that taller sidewalls are preferred. In any event, it is not necessary that the ceramic insert cover all or substantially all of the mold cavity walls. By providing a ceramic insert the amount of damage to the mold caused by the initial portion of the pour is reduced. I have been able to use a cast iron electrode mold with a ceramic insert like the mold shown in the drawings for 150 heats. This is a substantial increase in the service life of cast iron electrode molds.

The hot metal within the mold cools after having been poured to form a solid electrode. After the electrode has been formed a hammer press or other device strikes the top of the electrode pushing it downward through the mold cavity 5. As the electrode is removed from the mold, the ceramic insert remains on the end of that electrode. After the electrode has been removed from the mold the ceramic insert is broken away using a hammer or similar device.

Use of the ceramic insert eliminates all material loss from the end of the electrode covered by the insert, increasing the yield for the molding process. Indeed, I have found an increase in the yield using the electrode molds here described of as much as 75 pounds per electrode. This savings is significant. Consequently, the electrode mold with the ceramic insert here disclosed not only has a longer service life but also creates a higher yield.

Although I have described the mold as an electrode mold, metal ingots and other metal products can be with this mold.

The mold here described is suitable for molding a variety of nickel base metal alloys including corrosion resistant nickel-chromium alloys and nickel-chromium-cobalt high temperature alloys as well as many cobalt base alloys and titanium base alloys.

Although I have described certain present preferred embodiments of my ingot mold having a ceramic insert and casting method using this mold it should be distinctly understood that my invention is not limited thereto but may be variously embodied within the following claims:

I claim:

1. A mold for making metal products comprising:

a body having an open top, a bottom with an opening, and a longitudinal cavity passing through the body, the body having a cavity wall, extending from the open top to the bottom, the cavity being defined by the cavity wall, the cavity wall having a recess adjacent the opening in the bottom of the body, such that material can flow from the open top, through the cavity, through the opening in the bottom and out of the body when the opening in the bottom is not closed; and a ceramic insert having a bottom and sidewalls extending from the bottom, the ceramic insert sized and positioned within the cavity such that the sidewalls are in the recess in the cavity wall;

the ceramic insert and the opening in the bottom of the body being sized such that the ceramic insert closes the opening in the bottom of the body when the ceramic insert is in the recess in the cavity wall and the ceramic insert can be removed from the cavity by being moved in a direction away from the open top of the body.

2. The mold of claim 1 also comprising a pair of handles attached to the body.

3. The mold of claim 1 also comprising at least one lug attached to the ceramic insert.

4. The mold of claim 1 also comprising a bonding material on at least a portion of the sidewalls of the ceramic insert which bonds the ceramic insert to the body of the ingot mold.

5. The mold of claim 1 wherein the body is cast iron.

6. The mold of claim 1 wherein the ceramic insert is made of a high alumina ceramic.

7. The mold of claim 6 wherein the ceramic insert contains from 75% to 85% alumina.

8. The mold of claim 1 wherein the recess covers from 11% to 22% of the cavity wall.

9. The mold of claim 1 wherein the open top has an opening that is generally rectangular and the mold has a height of nine feet.

10. A method of casting molten metal comprising:

providing a mold comprised of a body having an open top, a bottom with an opening, and a longitudinal cavity passing through the body, the body having a cavity wall extending from the open top to the bottom, the cavity being defined by the cavity wall, the cavity wall having a recess adjacent the opening in the bottom of the body, and a ceramic insert having sidewalls and positioned within the cavity such that the sidewalls are in the recess in the cavity wall wherein the ceramic insert and the opening in the bottom of the body are sized such that the ceramic insert closes the opening in the bottom of the body when the ceramic insert is in the recess in the cavity wall and the ceramic insert can be removed from the cavity by being moved in a direction away from the open top of the body;

pouring molten metal through the open top into the cavity;

allowing the molten metal to cool within the cavity to form a metal product; and removing the metal product and the ceramic insert from the mold by pushing the metal product from the cavity in a direction away from the open top of the body.

11. The method of claim 10 wherein the ceramic insert is attached to the metal product after the metal product and ceramic insert are removed from the mold and also comprising removing the ceramic insert from the metal product.

12. The method of claim 10 wherein the body of the mold is cast iron.

13. The method of claim 10 wherein the ceramic insert is made of a high alumina ceramic.

14. The method of claim 13 wherein the ceramic insert contains from 75% to 85% alumina.

* * * * *